US006352113B1

(12) United States Patent
Neuroth

(10) Patent No.: US 6,352,113 B1
(45) Date of Patent: Mar. 5, 2002

(54) METHOD AND APPARATUS TO REMOVE COILED TUBING DEPLOYED EQUIPMENT IN HIGH SAND APPLICATIONS

(75) Inventor: David H. Neuroth, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/425,377

(22) Filed: Oct. 22, 1999

(51) Int. Cl.[7] ..... E21B 31/03

(52) U.S. Cl. ..... 166/301; 166/68; 166/106; 166/169; 166/311

(58) Field of Search ..... 160/301, 311, 160/312, 68, 105, 106, 385, 169

(56) References Cited

U.S. PATENT DOCUMENTS

| | | | | | |
|---|---|---|---|---|---|
| 3,020,957 | A | | 2/1962 | Tausch | |
| 4,450,907 | A | * | 5/1984 | Clark et al. | 166/223 |
| 4,582,131 | A | | 4/1986 | Plummer et al. | |
| 5,040,598 | A | | 8/1991 | Pleasants | |
| 5,146,982 | A | * | 9/1992 | Dinkins | 166/65.1 |
| 5,269,377 | A | | 12/1993 | Martin | |
| 5,447,200 | A | | 9/1995 | Dedora et al. | 166/311 |
| 6,012,518 | A | * | 1/2000 | Pringle et al. | 166/66.4 |
| 6,142,232 | A | * | 11/2000 | Troutt et al. | 166/312 |

* cited by examiner

*Primary Examiner*—David Bagnell
*Assistant Examiner*—Zakiya Walker
(74) *Attorney, Agent, or Firm*—Bracewell & Patterson, L.L.

(57) ABSTRACT

An electrical submersible pump assembly supported on coiled or continuous tubing. A power cable extends through the coiled tubing for supplying electrical power to the pump assembly. The cable has an outer diameter that is less than the inner diameter of the tubing, resulting in a cable annulus surrounding the cable. Supports attached to the cable frictionally or mechanically engage the cable with the coiled tubing to support the weight of the cable with the tubing. The supports define passages that allow fluid to flow by within the cable annulus from the surface. A port is provided in the coiled tubing at the electrical submersible pump assembly for discharging fluid pumped from the surface down the cable annulus. A tube may be provided to extend downward from the port alongside of the electrical submersible pump. Fluid may be pumped from an upper end of the well down the cable annulus and out of the port to free up sand accumulation on the packer.

6 Claims, 1 Drawing Sheet

METHOD AND APPARATUS TO REMOVE COILED TUBING DEPLOYED EQUIPMENT IN HIGH SAND APPLICATIONS

TECHNICAL FIELD

This invention relates in general to electrical submersible pump assemblies, and in particular, to an electrical submersible pump supported on coiled tubing with a feature to dislodge sand buildup from around the pump.

BACKGROUND OF THE INVENTION

Electrical submersible pumps for oilwells typically include a centrifugal pump mounted to a downhole electrical motor. In a conventional installation, the upper end of the pump secures to a lower end of a string of production tubing. The production tubing comprises threaded sections of tubing secured together, each about 30 feet long. The motor usually locates below the pump. exterior of the tubing. The tubing supports the weight of the pump assembly. The weight of the power cable is also supported by the tubing through the straps which secure the power cable to the tubing. The well fluid is produced through the tubing to the surface.

Periodically, the pump assembly must be pulled to the surface for replacement or maintenance. Also, the well may require maintenance. This requires a pulling unit which will unscrew and pull the sections of production tubing from the well. Pulling the pump and putting it back into the well on the sections of tubing can be time consuming. It also requires a unit which has a draw works for pulling the production tubing.

Another method of deploying a submersible pump is on coiled tubing. A power cable extends through the coiled tubing for supplying electrical power to the pump assembly. The cable has an outer diameter that is less than the inner diameter of the coiled tubing, resulting in a cable annulus surrounding the cable. Standoff means extend within the cable annulus for frictionally or mechanically engaging the cable with the coiled tubing to support the weight of the cable with the tubing.

When an electrical submersible pump or other equipment is deployed using coiled tubing in applications where there is high sand production in the tubing annulus, there is a high risk that when production is shut off prior to pulling the equipment, the sand will settle to the bottom and stick the equipment in the hole.

Previous attempts have been made to stir up the sand to facilitate pulling the equipment. For example, U.S. Pat. No. 3,020,957 to Tausch teaches pumping fluids down the annulus and up the coiled tubing to remove sand. U.S. Pat. No. 5,040,598 to Pleasants teaches forcing fluids down coiled tubing and discharging the fluid against the wall of the wellbore and the fishing neck of the operating tool to clean the wellbore and fishing neck. The fluid is forced down the tubing to move sand around prior to connecting the tool to expose the fishing neck of the downhole tools to increase ease of attachment.

SUMMARY OF THE INVENTION

In this invention, the electrical submersible pump assembly is supported on coiled or continuous tubing. The cable extends through the coiled tubing for supplying electrical power to the pump assembly. The cable has an outer diameter that is less than the inner diameter of the tubing, resulting in a cable annulus surrounding the cable. Standoff means extend in the cable annulus for frictionally or mechanically engaging the cable with the coiled tubing to support the weight of the cable with the tubing. Preferably, the cable annulus serves as a flow passage for circulating cooling or lubricating fluid from the surface.

A tubing annulus is defined by an exterior of the coiled tubing and an interior of the casing or liner. Preferably, the production from the pump flows around the exterior of the coiled tubing and up the tubing annulus to the surface. A packer or polished bore is adapted to be set in the tubing annulus for sealing a lower portion of the downhole electrical submersible pump assembly.

A port is provided in the coiled tubing at the electrical submersible pump assembly for discharging fluid pumped from the surface down the cable annulus. A tube may be provided to extend downward from the port alongside of the electrical submersible pump. Fluid may be pumped from an upper end of the well down the coiled tubing/cable annulus and out of the port to free up sand accumulation around the packer. The fluid may be a gas, such as nitrogen, which is blown out of the port into the annulus as close to the packer as possible. Forcing gas into the annulus at this point will loosen up the sand and allow the unit to be pulled.

Standoff members, such as welded dimples for supporting blocks attached to the cable or spring supports that are attached to the cable, are provided to support the cable within the coiled tubing. The standoff members allow fluids to pass. The cable annulus and standoff members allow fluid, such as gas, to be forced down the well in a unique and advantageous method of unsticking downhole equipment in sandy applications prior to pulling the unit.

DETAILED DESCRIPTION OF THE DRAWINGS

Figure 1A:
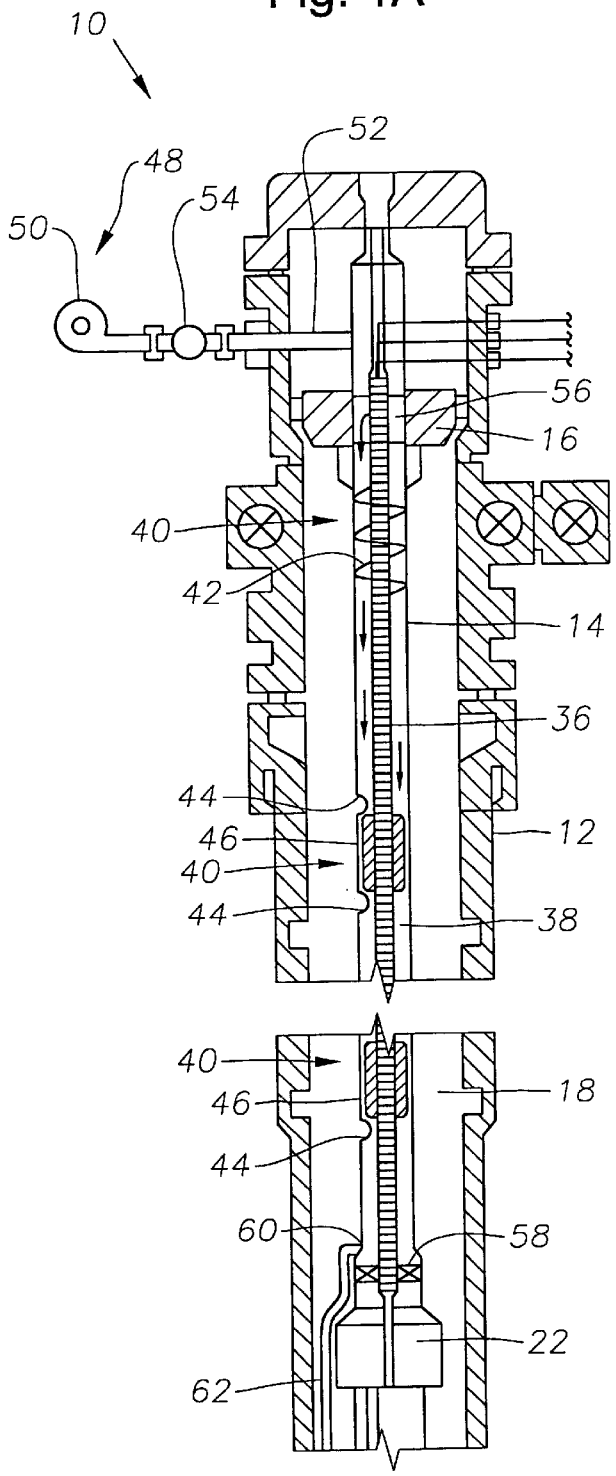
FIG. 1A is an upper portion of a partial cross-sectional view of a well pumping apparatus of the invention.
Figure 1B:
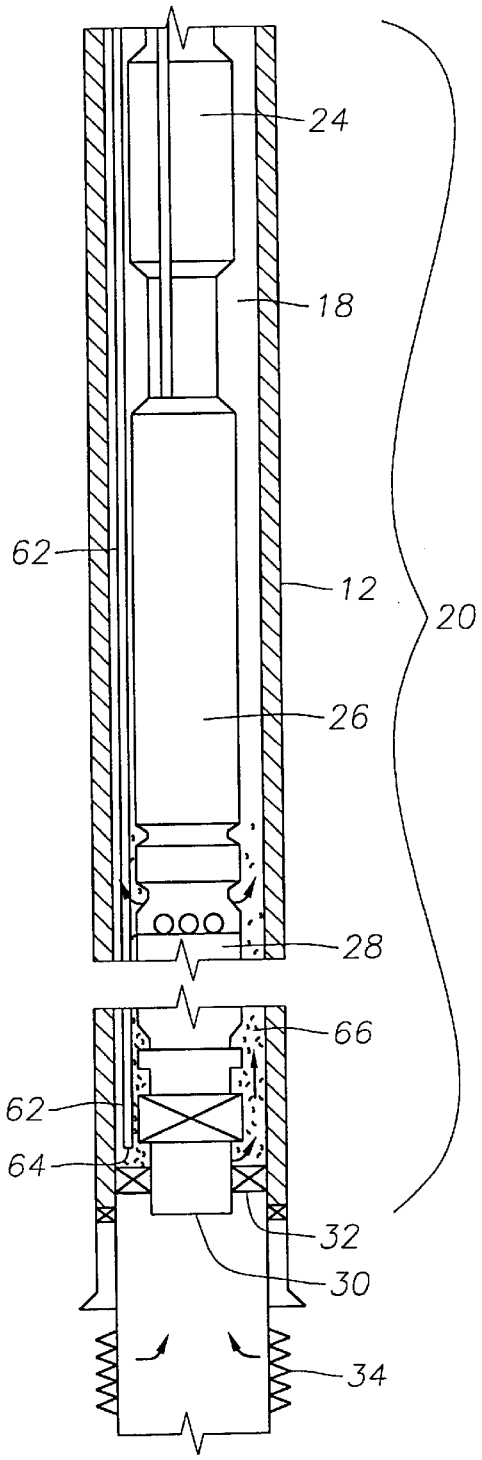
FIG. 1B is a lower portion of a partial cross-sectional view of a well pumping apparatus of the invention.

Referring now to FIGS. 1*a* and 1*b*, shown is a well designated generally 10. The well 10 has a string of casing 12. Coiled tubing 14 is deployed within casing 12, such as by suspending coiled tubing 14 on a coiled tubing hanger 16. The outside of coiled tubing 14 and the inside of casing 12 define a tubing annulus 18. A downhole electrical submersible pump (ESP) assembly, designated generally 20, is suspended from coiled tubing 14. ESP assembly 20 is used to pump well fluid up tubing annulus 18. In a preferred embodiment, ESP assembly 20 includes a shear sub 22, a seal section 24, a motor 26, a pump 28 and an intake stinger 30 extending downward therefrom. A polished bore seal or packer 32 is set within casing 12 for sealing a lower portion of the downhole ESP assembly 20. Therefore, when well fluid enters the well through perforations 34, the well fluid is prevented from flowing through the tubing annulus 18 by packer 32. Instead, well fluid flows through perforations 34 up through intake stinger 30 into the pump 28 of ESP assembly 20. Pump 28 then pumps well fluids up tubing annulus 18.

A power cable 36 is suspended within coiled tubing 14 to provide electrical power to the motor 26 of ESP assembly 20. An outer surface of power cable 36 and an inner surface of coiled tubing 14 define a cable annulus 38. Since power cable 36 is typically too heavy to support its own weight, it is desirable to provide cable supports 40. Cable supports 40 may include a support spring 42. Support spring 42 is described in greater detail in U.S. patent application Ser. No. 09/056,498, entitled "Coil Springs For Cable Support", which is incorporated herein by reference. Additionally, cable support 40 may be a combination of dimples 44 formed within coiled tubing 14 and blocks 46, which are secured to the power cable 36 and which rest upon dimples 44. The cable support 40, utilizing dimples 44 and blocks 46, is described in detail in U.S. patent application Ser. No. 09/019,139, entitled "Crimped Coiled Tubing Anchors For Cable", which is incorporated herein by reference.

A pump designated 48, which is preferably a compressor 50, is provided on the surface. Pump 48 communicates with a gas injection port 52. Gas injection port 52 preferably has a valve 54 provided thereon. Gas injection port 52 communicates with the cable annulus 38 at a point above the coiled tubing hanger 16. A passageway 56 is provided through coiled tubing hanger 16, so that pump 48 may pump fluid, such as a high pressure gas, e.g., nitrogen, down the cable annulus 38.

A cable annulus packer 58 is provided within cable annulus 38 at a lower end of coiled tubing 14. A port 60 is provided above the cable annulus packer 58. A tube 62 extends from port 60 downward from port 60 alongside of the ESP assembly 20. A lower end 64 of tube 62 preferably terminates at a location proximate packer 32. However, lower end 64 may terminate at a point well above packer 32 as desired. Fluid emitted from lower end 64 of tube 62 is used to stir up and loosen sand 66 that may collect around the ESP assembly 20 above the packer 32.

In operation, a compressor 50 pumps fluid, such as pressurized nitrogen, through gas injection port 52 and valve 54 into cable annulus 38. The fluid flows through passageway 56 and past cable supports 40 to port 60. The fluid then passes through tube 62 and out of lower end 64. The fluid stirs up and loosens sand 66 that has settled out of the production column or tubing annulus surrounding ESP assembly 20. After the sand 66 is stirred up and loosened, then an operator may commence pulling upward on the coiled tubing 14 for removal of the downhole assembly 20.

The invention has numerous advantages. Sand is agitated with injected fluid to make it easier to remove a downhole assembly with coiled tubing that is already in place. The invention may be used even though the coiled tubing may have been connected to the ESP assembly for a long period of time. Consequently, the fluids are not injected during insertion of the coiled tubing into the well. Instead, fluid is injected only when an operator intends to pull the tubing and ESP assembly from the well. The path of the injected fluid may be extended from the bottom of the coiled tubing to a point where the annulus is shut in by a packer or other seal. This allows for fluids to be emitted from a lower end of a tube at a point where most of the sand is collected. Therefore, gas may be bubbled into the area above the packer but below the downhole assembly to fluidize any sand or particulate that has gathered in the area, thereby forming a plug. If the downhole assembly is stuck due to the particulate matter, fluidizing the plug should make it easier to pull the ESP assembly.

Another advantage is that the cable annulus may be used to transmit injected fluid down the cable annulus inside of the coiled tubing. Previous devices have filled the cable annulus with a fluid in an attempt to provide support for the power cable. This invention utilizes cable supports that preserve an annular space between the cable and the inside of the coiled tubing. Therefore, fluid or gas may be forced down the well to be used to unstick downhole equipment in sandy well applications.

While the invention has been shown in only one of its forms, it should be apparent to those skilled in the art that it is not so limited, but is susceptible to various changes without departing from the scope of the invention.

I claim:

1. A well pumping apparatus for installation in a well having a casing and a downhole packer, comprising:

coiled tubing adapted to be deployed within said casing, defining a tubing annulus between the coiled tubing and the casing;

a downhole electrical submersible pump assembly suspended from said coiled tubing for pumping well fluid up said tubing annulus and adapted to be engaged with said packer;

a power cable suspended within said coiled tubing, wherein an outer surface of said power cable and an inner surface of said coiled tubing define a cable annulus;

a port in said coiled tubing at said pump assembly for discharging fluid supplied from surface level down said cable annulus; and a plurality of supports affixed to said power cable along a length of said power cable and engaging an inner surface of said coiled tubing for supporting weight of the cable, each of said supports defining a flow passage communicating with the cable annulus above and below each of said supports.

2. A well pumping apparatus for installation in a well having a casing and a downhole packer, comprising:

coiled tubing adapted to be deployed within said casing, defining a tubing annulus between the coiled tubing and the casing;

a downhole electrical submersible pump assembly suspended from said coiled tubing for pumping well fluid up said tubing annulus and adapted to be engaged with said packer;

a power cable suspended within said coiled tubing, wherein an outer surface of said power cable and an inner surface of said coiled tubing define a cable annulus;

a port in said coiled tubing at said pump assembly for discharging fluid supplied from surface level down said cable annulus into the vicinity of said pump assembly; and a source of pressurized gaseous fluid located at an upper end of said well for supplying the fluid down said cable annulus.

3. In a well having a casing with coiled tubing deployed within said casing, a tubing annulus defined by said coiled tubing and said casing, a downhole electrical submersible pump assembly suspended from said coiled tubing for pumping well fluid up said tubing annulus, a packer set in said casing for sealing a lower portion of said downhole pump assembly to said casing, a power cable suspended within said coiled tubing, wherein said outer surface of said power cable and an inner surface of said coiled tubing define a cable annulus, the improvement comprising:

a port in said coiled tubing proximate said pump assembly;

a tube extending downward from said port alongside said pump assembly;

a plurality of supports affixed to said power cable along a length of said power cable and engaging an inner surface of said coiled tubing for support weight of the cable, each of said supports defining a flow passage communicating with the cable annulus above and below each of said supports; and a pressure source located at an upper end of said well for pumping fluid down said cable annulus, through said port and out said tube to agitate any sand accumulation around said pump assembly on said packer.

4. The well according to claim 3, wherein said pressure source is a compressor.

5. A method of removing a downhole pump assembly from a well, wherein the pump assembly is suspended on coiled tubing and engaged with a packer set in casing, the coiled tubing containing a power cable therein, which defines a cable annulus within the coiled tubing, the method comprising:

providing a port in the coiled tubing adjacent to the downhole pump assembly;

delivering fluid from an upper end of the well down the cable annulus and out of the port to free up sand accumulation on the packer; and pulling upward on the coiled tubing.

6. The method according to claim 5, further comprising the step of:

attaching a tube to the port and extending the tube downward alongside the pump assembly proximate the packer.

* * * * *

UNITED STATES PATENT AND TRADEMARK OFFICE

CERTIFICATE OF CORRECTION

PATENT NO. : 6,352,113 B1
DATED : March 5, 2002
INVENTOR(S) : David H. Neuroth

It is certified that error appears in the above-identified patent and that said Letters Patent is hereby corrected as shown below:

Column 4,
Line 66, delete "support" and insert therefor -- supporting --

Signed and Sealed this

Eleventh Day of June, 2002

*Attest:*

*Attesting Officer*

JAMES E. ROGAN
*Director of the United States Patent and Trademark Office*